United States Patent [19]

Yother

[11] Patent Number: 5,065,487

[45] Date of Patent: Nov. 19, 1991

[54] OIL PUMP INSTALLATION TOOL

[76] Inventor: Cecil Yother, 1740 Timothy Dr., San Leandro, Calif. 94577

[21] Appl. No.: 245,697

[22] Filed: Sep. 19, 1988

[51] Int. Cl.[5] ..... B25B 27/14

[52] U.S. Cl. ..... 29/275

[58] Field of Search ..... 29/275, 276, 277

[56] References Cited

U.S. PATENT DOCUMENTS

| | | | |
|---|---|---|---|
| 1,914,257 | 6/1933 | Holmes | 29/275 |
| 2,292,898 | 8/1942 | Peirce | 29/275 |
| 2,462,774 | 2/1949 | Pollock | 29/275 |
| 2,853,723 | 9/1958 | Winslow | 29/275 |
| 2,861,330 | 11/1958 | Kratz | 29/275 |
| 3,228,269 | 1/1966 | Heyer | 29/275 |

*Primary Examiner*—J. J. Hartman

*Attorney, Agent, or Firm*—Bruce & McCoy

[57] ABSTRACT

An automobile engine oil pump pickup tube installation tool for driving an oil pump pick up tube into an oil pump mounted in an engine block with a force fit, the tool having a slot formed in one end thereof with a hardened metal end plate at the end of the slot for engaging the tube of the oil pump.

3 Claims, 1 Drawing Sheet

OIL PUMP INSTALLATION TOOL

BACKGROUND OF THE INVENTION

1. Field Of The Invention

The present invention relates to automobile engine oil pump installation tools and more particularly to an installation tool for driving the oil pick up tube of an oil pump into the pump.

2. Description Of The Prior Art

A mechanic working in the field and installing an oil pump on certain automobile engines, as opposed to a factory worker assembling an engine, has a very difficult problem. At the factory, the tube can be force fitted into the pump before it is installed in the engine block. In the field, it is difficult to force fit the tube into the pump if they are disassembled. It is easiest to mount the pump in the automobile engine block to give it support and then fit the tube in the pump. However, the oil pump pickup tube, which must be force fitted into the oil pump, is in particular cases a curved tube in that portion of its length between the oil pickup end and the straight end of the tube which is inserted into the pump. A bulged flange is usually formed in the straight portion of the tube disposed in spaced relation to the end of the tube which is inserted into the pump. When the tube is inserted into the receiving hole in the pump, the bulged flange seats against the surface of the pump and forms a stop limiting the depth to which the tube can be pushed into the pump. The problem is how to grasp the curved tube above the bulged flange and apply force to it so as to drive the straight end of the tube into its receptacle with a force fit.

The most common way to force fit the oil pickup tube into the pump without a special tool is for the mechanic to first mount the pump in the engine block and then grab the oil pickup tube above the bulged flange with a pair of pliers and pound on the pliers to force the tube into the pump. Otherwise it is necessary to pound directly on the tube or on the oil pump in an effort to force the tube into the block. There are many problems with these procedures in that the tube can be crushed, or scored, or the procedure can actually damage or destroy the pump during the installation attempt. In either case, the procedures can possibly create metal shavings or particles which can fall into the engine to later cause engine wear or failure or to reduce the flow of the oil through the pump.

The present invention is a tool which encircles that portion of the oil pump pickup tube above the bulged flange so that the tool can apply a force to the flange aligned with the straight end of the tube below the flange. In other words, the tool can be inserted over the curved portion of the tube to bear at one end against the bulged flange, and the other end of the tool can be pounded upon with a hammer or other driving instrument. The driving force, by virtue of the configuration of the installation tool, aligns behind the straight end of the tube to drive it straight into the pump mounted in the engine block.

The oil pump installation tool of the present invention overcomes the problems of the mechanic in the field who must apply force to a curved oil pump pickup tube by providing a simple tool which allows a force to be selectively applied only to the end of the tube, and that force is aligned with the direction with which the tube must be driven to enter and engage the pump mounted in the engine block.

SUMMARY OF THE INVENTION

The present invention is an oil pump pickup tube installation tool which has a driver portion with a slot formed in one end thereof extending for only a portion of the length of the driver. A removable end plate having a U-shaped notch is secured to the notched end of the driver with the notch aligned with the slot formed in the driver. The slot formed in the driver is large enough to allow the curved pickup tube of the oil pump above the bulge or flange, usually formed in the tube, to be enclosed in that end of the driver. The driver portion of the tool aligns with the straight end of the oil pickup tube when the tool bears against the bulged flange whereby force applied to the driver portion of the tool applies a force directly on the flange of the pickup tube. That force is aligned with the direction that the end of the tube, which must be inserted into the oil pump, must travel.

OBJECTS OF THE INVENTION

It is therefore an important object of the present invention to provide an oil pump installation tool which can surround a portion of an oil pump pickup tube and engage it securely enough to allow pounding on the tool to drive the tube into a force fit with its receptacle.

It is another object of the present invention to provide an oil pump installation tool which can be made of two different metals: a hardened metal for engaging the bulged flange of an oil pump pickup tube, and a softer metal to accept the blows from a hammer or other driving force used for installing the oil pump pickup tube in the pump.

It is a further object of the present invention to provide an oil pump installation tool which can be used to install different sized oil pump pickup tubes by providing a different sized slot in the hardened metal end for engaging the different diameter oil pump pickup tube bulged flanges.

Other objects of the present invention will become apparent when the description of the preferred embodiment thereof is considered in conjunction with the accompanying drawings.

DESCRIPTION OF THE PREFERRED EMBODIMENT

Figure 1:
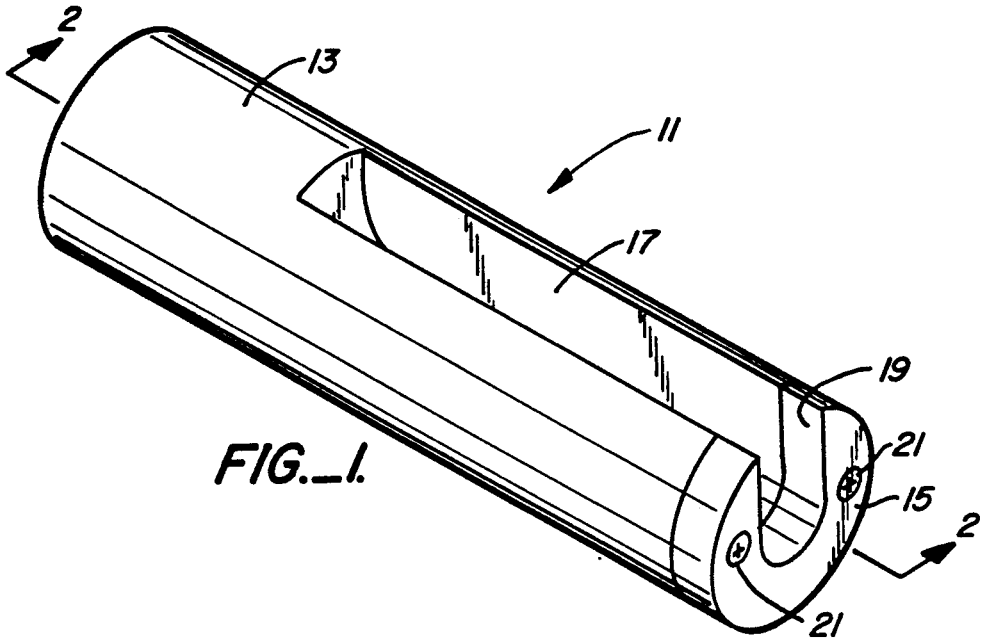
FIG. 1 is a perspective view of the oil pump installation tool of the present invention.
Figure 2:
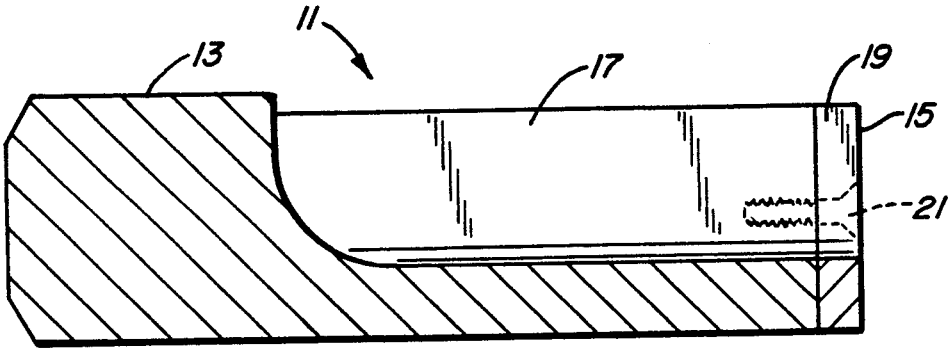
FIG. 2 is a side elevation in cross-section taken along lines 2—2 of FIG. 1.

The preferred embodiment of the oil pump installation tool 11, for installing oil pump pickup tubes in oil pumps of automobile engines, illustrated in FIGS. 1 and 2, is made with a two-part construction. This two-part construction allows the tool to be adapted to different diameter oil pickup tubes of different sized oil pumps and to utilize different type metals in the construction of the tool.

The tool includes a driver portion 13 which is made of a relatively soft metal as compared with the removable end plate 15 which is secured thereto. The softer metal is easier to machine during manufacture and absorbs the blow of a hammer by deforming thereby lessening the possibility of splinters flying off. The driver portion is made with a rugged construction design so that it can be hit with a hammer or other driving tool to drive the pickup tube of the oil pump into its force fit engagement with its receptacle in the oil pump. In its simplest configuration, the driver portion can be made out of a cylindrical piece of bar stock.

A slot 17 is formed in one end of the driver portion 13. It extends for only a portion of the length of the driver and is formed large enough to allow the pickup tube of the oil pump to be enclosed therein for a portion of its length. The oil pickup tube for particular types of oil pumps has a straight portion at the end thereof equal to the length of tube which is embedded in the oil pump when the pump is mounted and secured in its operational position. A bulged flange formed in the tube between the curved portion and the straight end of the tube limits the length of the tube which can be inserted into the pump. The bulged flange bears against the surface of the pump when the pickup tube is fully seated.

Between the bulge and the oil pump, the pickup tube is curved, usually into approximately a 90° bend to minimize the depth at which the oil pump projects into the oil pan of the engine. Thus, the pickup tube projects from the pump essentially in a curve, from the bulged flange to the pickup end. Therefore, when the installation tool 11 is placed in engagement with the bulged flange on the tube, the tube is enclosed in the slot 17 but curves out of it toward the pickup end.

Figure 3:
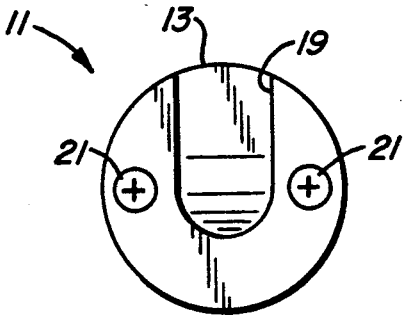
FIG. 3 is an end elevation of the oil pump installation tool of the present invention showing the hardened end plate.

The removable end plate 15 has a U-shaped notch 19 and is secured to the end of the driver portion 13 of the tool with its notch aligned with the slot 17 in the tool. The end plate, illustrated in FIGS. 1-3, is made of a hardened metal, as compared with the driver portion of the body, although in its simplest form the whole tool could be of a medium hard metal in which the end plate is not made removable and is formed integral to the driver portion of the body. The driver could also be made of an extruded bar stock having a slot formed for the whole length thereof, but if it were, pounding on the driver end would deform the metal and the slot, very quickly causing a short life expectancy for the tool.

The notched end plate 15 is formed to closely surround the outside diameter of the oil pickup tube and to engage the bulged flange. The bottom of the notch 19 engages approximately 180° of the bulged flange. When force is applied to the tool, it is distributed in shear equally around the 180° of contact between the end plate and the pickup tube flange. This amount of contact has proven sufficient to drive the oil pickup tube into its force fit with an oil pump without damage to the oil pickup tube or the oil pump and without shearing metal off the oil pickup tube which might fall into the engine.

Figure 4:
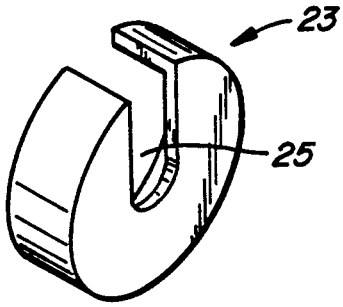
FIG. 4 is a perspective view of a removable end cap.

By making the end plate 15 removable, different sized notches 19 can be made in different end plates whereby the tool can be adapted to fit different diameter oil pump pickup tubes. The end plate is secured to the driver portion 13 by recessed screws 21 for easy assembly and changing of the end plates. A simple quick change adapter 23 has been devised as illustrated in FIG. 4. It is formed like a ketchup bottle cap (no engagement threads —just friction fit) but with a formed slot 25 in the side and top thereof. The adapter can be slipped on and off the tool more quickly than changing end plates to adapt to different diameter oil pickup tubes. The adapter plate can also be magnetized to adhere to the fixed end plate. Either means for changing sizes of the slot in the end plate works as well as the other.

Thus, it will be seen from this description of the preferred embodiment of the present invention that the oil pump installation tool disclosed and described herein achieves the objects and advantages attributable thereto, and while the invention has been described in considerable detail, it is not to be limited to such detail as has been set forth except as may be necessitated by the appended claims.

What is claimed is:

1. An oil pump pickup tube installation tool comprising a driver portion having a slot formed in one end thereof and extending for only a portion of the length of said driver, and an end plate with the same peripheral configuration as said driver portion made of hardened metal removably secured to the slotted end of said driver and having a U-shaped notch formed therein and aligned with said slot.

2. The oil pump pickup tube installation tool of claim 1 wherein the driver portion and the end plate are cylindrical and the same diameter.

3. The oil pump pickup tube installation tool of claim 1 including an end cap which fits over the end plate and has a U-shaped notch formed therein of a smaller size than the one in said end plate and aligned therewith.

* * * * *